United States Patent [19]

Hornung

[11] 3,998,449

[45] Dec. 21, 1976

[54] METHOD AND APPARATUS FOR FEEDING ITEMS FROM A STACK

[75] Inventor: Helmut O. Hornung, Altoona, Pa.

[73] Assignee: F. L. Smithe Machine Company, Inc., Duncansville, Pa.

[22] Filed: June 30, 1975

[21] Appl. No.: 592,064

[52] U.S. Cl. ..... 271/112; 271/12; 271/94; 271/108; 271/119; 271/271

[51] Int. Cl.[2] ..... B65H 3/10; B65H 5/12

[58] Field of Search ..... 271/12, 13, 94, 96, 271/99, 108, 112, 119–121, 271

[56] References Cited

UNITED STATES PATENTS

| | | | |
|---|---|---|---|
| 2,623,746 | 12/1952 | Gegenheimer et al. | 271/271 |
| 2,817,519 | 12/1957 | Beck | 271/94 |
| 2,852,255 | 9/1958 | Fischer | 271/94 |
| 3,291,482 | 12/1966 | Stemmler | 271/94 |

FOREIGN PATENTS OR APPLICATIONS

| | | | |
|---|---|---|---|
| 19,703 | 8/1907 | Norway | 271/121 |

*Primary Examiner*—Robert W. Saifer
*Attorney, Agent, or Firm*—Stanley J. Price, Jr.; John M. Adams

[57] ABSTRACT

A stack of items having an irregular thickness such as folded sheets, booklets, filled envelopes and the like are positioned in a stack receiver with the stack leading edge resting against the pair of support rails. The stack lowermost item is supported adjacent its rear edge by rotatable supports mounted adjacent to a feed cylinder. A depending wiper device is mounted adjacent the leading edge of the stack and has a flexible bottom edge portion that is positioned either abutting or closely adjacent the cylinder surface. The feed cylinder positioned below the stack has a longitudinal protuberance that extends beyond the cylinder surface and is arranged upon rotation of the cylinder to contact the lowermost item of the stack and move this item between the wiper bottom edge and the cylinder to a position where the leading portion of the lowermost item is moved beyond the wiper device. The cylinder has a plurality of longitudinally extending rows of vacuum ports that are progressively activated as the rows pass beyond the wiper mechanism. The underside of the lowermost item is held against the cylinder surface by the vacuum and is transferred by the cylinder to a conveying device.

12 Claims, 14 Drawing Figures

METHOD AND APPARATUS FOR FEEDING ITEMS FROM A STACK

BACKGROUND OF THE INVENTION

1. Field of the Invention

This invention relates to a method and apparatus for feeding items from a stack and more particularly to a method and apparatus for feeding items from the bottom of a stack.

2. Description of the Prior Art

Sheet feeders for feeding plain single sheets and folded sheets and envelopes are known. Generally the feeder devices can be classified as top-sheet feeders and bottom-sheet feeders. In a top-sheet feeder the uppermost or top sheet is removed from a stack by the feeder mechanism and serially conveyed to other devices. In a bottom-sheet feeder the lowermost sheet is removed from the stack by the feeder mechanism and conveyed serially to other devices.

Examples of feeders are disclosed in the following U.S. Pat. Nos. 1,385,468; 2,195,576; 1,127,796; 2,251,945 and 2,853,296. The first two patents relate to top-sheet feeder mechanisms where the uppermost sheet is removed from the stack. In U.S. Pat. No. 1,385,468 a cylinder is positioned above an endless conveyor and closely adjacent thereto. The stack of sheets abut the nip between the cylinder and the endless conveyor and the leading edge is suitably supported on a spring-loaded arm. The upper cylinder has a resilient insert that has a surface that conforms with the configuration of the cylinder surface. The resilient member frictionally engages the uppermost sheet and moves it into frictional engagement with the endless conveyor positioned therebelow. U.S. Pat. No. 2,195,576 discloses a similar top-sheet feeder where a pair of cylinders are positioned in substantially abutting relation with each other and adjacent to the stack. Again the leading edge of the stack is supported by a support member and the upper cylinder has a plurality of resilient inserts therein that frictionally engage the uppermost sheet and convey the uppermost sheet to the nip between the adjacent cylinders. An auxiliary feed device is provided to urge the trailing edge of the uppermost sheet toward the nip between the cylinders. The top-sheet feeder as disclosed in the above patents is unsuitable for feeding items having irregular thickness or filled envelopes. Further the top-sheet feeders disclosed are not suitable to feed mixed items of various thicknesses. Where more than one of the sheets is withdrawn from the stack, i.e., two of more sheets, the plurality of sheets are removed from the stack and are fed by the above-discussed feeders as a multiple of sheets causing jams in the mechanism to which the sheets are fed. Neither of the top-sheet feeders provide a means to feed only single sheets from the stack and to distinguish between a single and multiple sheets withdrawn from the stack.

The next three enumerated patents disclose bottom-sheet or item feeders. U.S. Pat. No. 1,127,796 discloses a feeder for envelopes which includes a segmented cylinder that engages the lowermost envelope and removes the lowermost envelope from the stack. U.S. Pat. No. 2,251,945 discloses a bottom-sheet feeder wherein the cylinder has a plurality of rows of vacuum ports that engage the bottom sheet and position the bottom sheet on an endless conveyor. U.S. Pat. No. 2,853,296 is similar to the last-named patent in that a plurality of vacuum ports are provided on a cylinder to engage the bottom sheet of the stack and convey the bottom sheet to another conveyor means. None of these references, however, provide apparatus that is suitable to feed mixed items of various thicknesses nor to distinguish between single and multiple items removed from the stack that are thereafter singly separated from each other and conveyed as single sheets or elements to a second conveyor.

There is a need for a feeder device that is capable of feeding items of various thicknesses and feeding only single items to another conveying device. There is also a need for a feeder device that prevents more than one item from being completely removed from the stack at the same time.

SUMMARY OF THE INVENTION

In accordance with the present invention the item feeder apparatus includes a stack receiver arranged to support a stack of items. A cylinder is rotatably mounted adjacent to and beneath the stack receiver. The cylinder has a protuberance extending beyond the cylinder surface and a vacuum means on the cylinder surface positioned adjacent to the protuberance. A wiper device is positioned adjacent to the cylinder surface and adjacent to the stack receiver. The protuberance is arranged upon rotation of the cylinder to contact the lowermost item in the stack positioned on the stack receiver and move at least the leading portion of the lowermost item beyond the wiper device. A valve means is provided to actuate the vacuum means on the cylinder when the vacuum means rotates past the wiper device so that the undersurface of the lowermost item is engaged to the cylinder surface.

The method for feeding items from the stack includes positioning a stack of items in a stack receiver above a rotatable cylinder having a protuberance projecting beyond the surface of the cylinder and vacuum means on the surface of the cylinder and rotating the cylinder in a direction toward the leading edge of the stack. Striking the lowermost item in the stack with the protuberance and moving the lowermost item in the direction of cylinder rotation. Thereafter engaging the undersurface of said lowermost item to the surface of said cylinder by said vacuum means and moving the lowermost item away from the stack by said vacuum means.

The above-described apparatus for feeding items from a stack is suitable for feeding items having an irregular thickness or filled envelopes. Where more than one of the items is withdrawn from the stack, the vacuum means engages only the lowermost item and the wiper device maintains the next-to-lowermost item adjacent to the stack so that only a single item is fed from the stack. The feeder apparatus is capable of feeding only single items to another conveying device and preventing more than one item from being completely removed from the stack.

Accordingly, the principal object of this invention is to provide a method and apparatus for feeding items of different thickness from the bottom of a stack.

Another object is to provide a method and apparatus for removing only single items from the bottom of the stack.

These and other objects and advantages of this invention will be more completely described and disclosed in the following specification, the accompanying drawings and the appended claims.

DESCRIPTION OF THE PREFERRED EMBODIMENT

Figure 1:
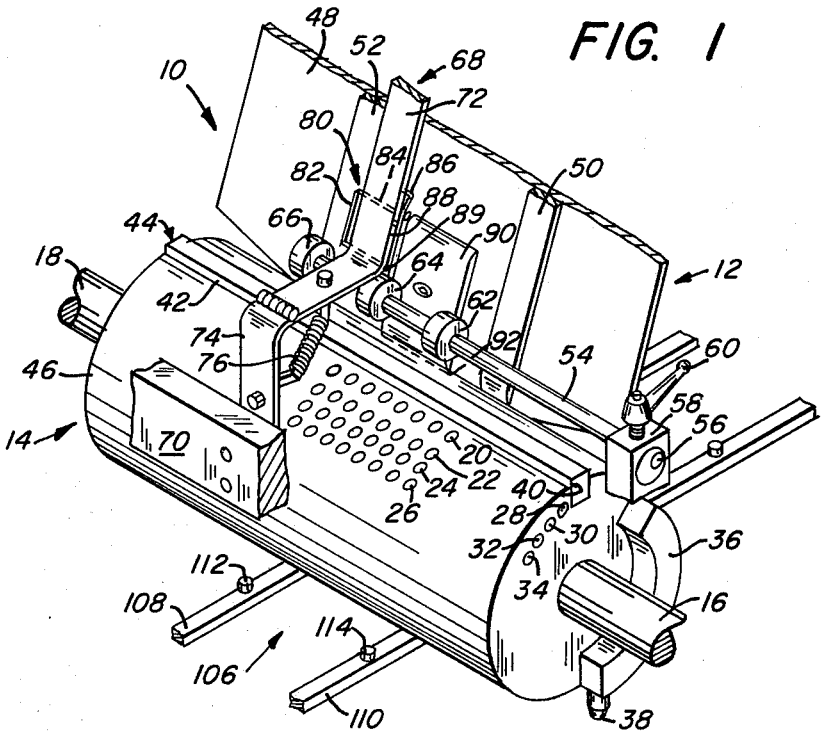
FIG. 1 is a front perspective view of the feeder apparatus illustrating the longitudinally extending protuberance and rows of vacuum ports on the surface of the feeder cylinder.

Throughout the specification the stack of material that is separated by the feeder apparatus shall be referred to as a stack of separate items. The items can be either single sheets, folded sheets, cards, multi-sheet booklets, envelopes, both empty and stuffed or filled envelopes. As previously described known feeders are sensitive to stack height and the thickness of the items in the stack. The hereinafter described feeder apparatus is suitable to feed any of the above items and particularly thick items such as booklets, filled envelopes and the like. The hereinafter described feeder apparatus is also suitable to feed items that are heavily printed with inks that exhibit a high sliding coefficient of friction.

Referring to the drawings the feeder apparatus is generally designated by the numeral 10 and includes stack receiver 12 with a cylinder 14 positioned therebelow. The cylinder 14 has shaft portions 16 and 18 that are suitably mounted in a frame mechanism (not shown) and one of the shaft portions is connected to a drive gear (not shown). The drive gear may, in turn, be connected in a gear train to rotate the cylinder 14 in timed relation to other elements associated with the feeder.

The cylinder 14 has a series of radially extending vacuum ports that are longitudinally aligned in rows. The ports in each row and the respective rows are designated by the numerals 20, 22, 24 and 26. Longitudinal ducts or bores 28, 30, 32 and 34 are connected to the respective rows of ports 20–26. A stationary valve device 36 is connected to a source of vacuum through opening 38. The valve 36 is stationary and is arranged to progressively or sequentially apply vacuum through longitudinal ducts 28–34 to the rows of vacuum ports 20–26. The stationary valve 36 is of conventional construction and any suitable valve means to progressively apply and remove a vacuum in the respective rows of ports 20–26 through ducts 28–34 as the cylinder rotates through preselected positions may be used. The term progressively applying vacuum by means of valve 36 is intended to designate first applying vacuum through duct 28 to the row of ports 20 and on further rotation of the cylinder 14 to thereafter apply vacuum through duct 30 to rows of ports 22 and thereafter apply vacuum through duct 32 to rows of ports 24 and finally through duct 34 to rows of ports 26. With this arrangement, as the cylinder 14 rotates and the rows of ports 20–26 pass a preselected position relative to valve 36, vacuum is applied progressively to the rows of ports 20–26 as each row passes the preselected position during cylinder rotation.

The cylinder 14 has a longitudinal slotted or recessed portion 40 that is positioned closely adjacent to the first row of vacuum ports 20. Secured in the recessed portion 40 is one or more bars 42 that will also be referred to as a protuberance 44 on the surface 46 of cylinder 14. Although the protuberance 44 is illustrated in the preferred embodiment as a longitudinal bar 42 positioned in a recessed portion 40 it should be understood that any protuberance from the surface 46 of the cylinder 14 that is suitable to strike or contact the lowermost item in a stack of items and move the lowermost item in the direction of cylinder rotation may be utilized without departing from the invention.

The protuberance 44 projects beyond the cylinder surface 46 and may have any desired configuration as, for example, the rectangular configuration illustrated. The bar 42 may be fabricated from any suitable material. It is preferred that the bar 42 be fabricated from either elastomeric material or synthetic resin material such as polyurethane or the like. The protuberance 44 is arranged after contacting and moving the lowermost item to frictionally engage the underside of the lowermost item in the stack as will hereinafter be described.

The stack receiver 12 has a backing plate 48 extending upwardly from the cylinder 14. The backing plate 48 has a pair of rails 50 and 52 thereon which are arranged to support the front portion of the stack of items fed to the feeder apparatus. Side rails (not shown) may also be provided to maintain the side portions of the stack aligned when positioned against the rails 50 and 52. A support rod 54 has an end portion 56 eccentrically positioned in a block member 58 and secured therein by means of a clamping device 60. The block 58 is, in turn, secured to or may form a part of the frame of the feeder apparatus 10. Rotatably mounted on the support rod 54 are a plurality of rollers 62, 64 and 66. With this arrangement, the front or leading edge of the stack is arranged to abut the rails 50 and 52 and the lowermost item in the stack has its trailing or rear edge portion rotatably supported on the rollers 62–66. The rollers are positioned above the cylinder 14 so that the trailing edge of the lowermost item is above the cylinder 14 while the front portion of the lowermost item in the stack is positioned closely to or abuts the cylinder surface 46.

An auxiliary support generally designated by the numeral 68 is secured to a bar 70 and includes a first angular plate 72 that is hingedly connected to a second plate 74. A spring 76 resiliently urges the upper plate member 72 toward the back-up plate 48 to thus urge the stack against the rails 50 and 52. A guide member generally designated by the numeral 80 is secured to the strip member 72 and includes a generally rectangular wire member 82. The upper horizontal arm 84 of guide 80 is hingedly secured to the strip 72 and a spring 86 is engaged at one end to strip 72 and urges the vertical arms 88 and lower member 89 toward the plate 48. With this arrangement the guide member 80 fans out or staggers the items in the stack toward the rails 50 and 52 expecially when only a few items such as 10 items remain in the stack. As an alternative, as illustrated schematically in FIG. 14, a guide plate 120 having a curved lower portion 122 may be pivotally secured to auxiliary support 68 at pivot point 124 and pivotally connected to an arm 126 at pivot point 128. The arm 126 has a horizontally extending section 130 that extends over the end of cylinder 14. A roller bearing 132 is secured to the side of cylinder 14, and on each revolution strikes the arm 130 to guide plate 120 away from the stack 116. The guide plate 120 then swings toward the stack and fans out the few items remaining in the stack to assist in feeding the last few items from the stack.

Figure 2:
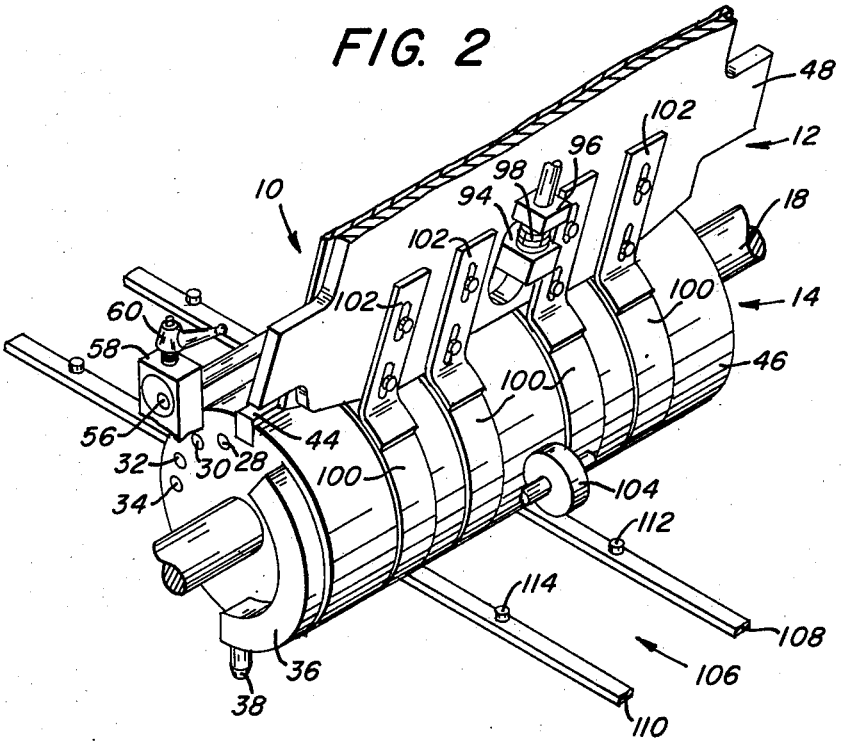
FIG. 2 is a rear perspective view of the feeder apparatus illustrating the arcuate guides for the item removed from the bottom of the stack.
Figure 3:
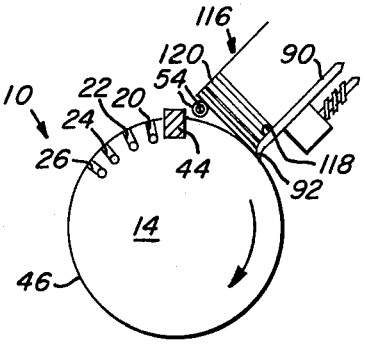
FIGS. 3–7 are schematic illustrations of the manner that the items are removed from the bottom of the stack by the rotating cylinder and deposited on an endless conveyor positioned beneath the cylinder.

A flexible wiper 90 has a bottom edge portion 92 that abuts or is closely adjacent to the surface 46 of cylinder 14 (FIGS. 1 and 3). The flexible wiper is preferably fabricated from a resilient or elastomeric material having a relatively flexible bottom edge 92. The flexible wiper 90 is secured to a rearwardly extending block member 94 (FIG. 2) that is vertically adjustable by means of a screw element 96 and has a spring 98 urging the wiper device 90 downwardly and opposing upward vertical movement thereof.

Adjustable arcuate guides 100 are secured to the rear portion of the stack receiver backing plate 48 and have a configuration similar to the cylinder surface 46. The arcuate guides 100 are suitably supported from the back-up plate 48 by strap members 102. The strap members are movable vertically relative to the plate 48 to thus adjust the relative position of the guides 100. An auxiliary feed wheel 104 is mounted adjacent to the cylinder 12 and is arranged to urge the item removed from the stack against the cylinder surface 94. It should be understood, however, that the auxiliary feed wheel 104 is not essential to the operation of the above-described feeder mechanism since as later described the vacuum ports 20–26 maintains and conveys the lowermost item from the stack. An endless chain receiver generally designated by the numeral 106 (a portion of which is illustrated in FIGS. 1 and 2) has a pair of endless chains 108 and 110 that extend beneath the cylinder 14. The chains each have a plurality of aligned upwardly extending pairs of pins 112 and 114 are arranged in spaced relation along the chains 108 and 110. The pins 112 and 114 are arranged to abut the items discharged from the cylinder 14 and convey the items discharged from the cylinder 14 serially to other apparatus.

The operation of the item feeder apparatus is illustrated schematically in FIGS. 3–7 and in FIGS. 8–13. The rails 50–52 and the auxiliary support 68 are not shown in these schematic drawings to more clearly illustrate the operation of the feeder apparatus 10. Referring to FIGS. 3–7, the stack of items is generally designated by the numeral 116 and the items and the stack 116 have a leading or front edge portion 118 and a trailing or rear edge portion 120. The items in stack 116 have their front edge portions 118 abutting the wiper mechanism 90 and the stack lowermost item 122 has its leading edge portion abutting the wiper mechanism lower edge portion 92. In this embodiment the lowermost item 120 has its front portion resting on the cylinder surface 46. It should be understood, however, that the lowermost item may be positioned above and out of contact with the cylinder surface 46. The lowermost item 122 has its trailing edge portion 120 supported on rollers 62–66 mounted on rod 54.

Figure 4:
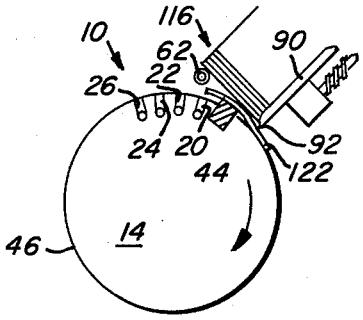

As illustrated in FIG. 3, the cylinder 14 is rotating in a clockwise direction with the protuberance 44 moving toward the underside of the stack 116. The vacuum ports 20–26 in FIGS. 3, 4 and 5 are deenergized so that the surface of the cylinder 46 does not have a negative pressure applied thereto by means of vacuum ports 20–26.

As the cylinder rotates in a clockwise direction the protuberance 44 contacts the lowermost item 122 and in striking the item 122 moves its front edge portion beneath the wiper lower edge 92 (FIG. 4) where the top surface of the item is frictionally engaged by the wiper lower edge 92. As previously stated, it is preferred that the wiper mechanism 90 be fabricated of a flexible material so that the wiper lower edge portion 92 is free to deflect when the lowermost item 122 is moved by the protuberance 44.

Figure 5:
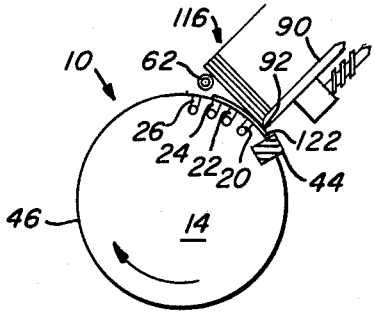
Figure 6:
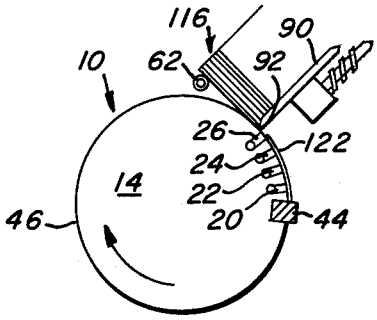

As the protuberance 44 progresses to the position illustrated in FIG. 5, the front edge 118 of the lowermost item 122 slips downwardly off of the protuberance 44 against the cylinder surface 46. In the position illustrated in FIG. 5, the vacuum ports 20–26 are deenergized. The valve mechanism 36 is so arranged to actuate the vacuum ports 20–26 at a location slightly beyond the wiper lower edge portion 92. Thus, in FIG. 5, as the vacuum port 20 passes beneath the wiper lower edge portion 92, the valve mechanism 36 opens the duct 28 to vacuum so that the vacuum ports 20 exert a negative pressure on the cylinder surface 46. The negative pressure through vacuum ports 20 engage a portion of the lowermost item 122 that extends beyond the wiper mechanism lower edge portion 92 and engages the undersurface of that portion of the lowermost item 122 to the cylinder surface 46. As the cylinder 14 continues to rotate the vacuum ports 22, 24 and 26 are actuated and subjected to a vacuum by means of stationary valve 36 as the respective ports pass beneath the wiper mechanism lower edge portion 92. With this arrangement, the undersurface of the lowermost item 122 is engaged to the cylinder surface 46 by means of vacuum and is conveyed by the cylinder 14, as is illustrated in FIG. 6. It should be noted, however, that in FIGS. 3–7 only a single item, i.e. the lowermost item 122 has been moved by the protuberance 44 on cylinder 46 and the other items remain in the stack 116.

Figure 7:
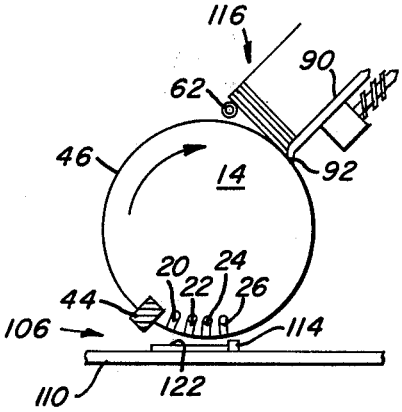

When the cylinder 14 rotates to the position illustrated in FIG. 7, the valve mechanism 36 turns off the vacuum to the ports 20–26 and the lowermost item 122 is released from the cylinder surface 46. As previously described, the lowermost item is deposited on the endless chains 108 and 110 of endless conveyor 106 and the rear edge portion of the lowermost item 122 abuts the pin members 114 and the lowermost item 122 is then conveyed to a suitable receiver.

It will be apparent from the above description of operation that the lowermost item is first contacted by the protuberance 44 on cylinder 14 and at least the front edge portion is advanced beneath the wiper mechanism lower edge portion 92. The stationary valve 36 is arranged to actuate the respective rows of ports 20–26 after the ports have passed beneath the wiper mechanism 90 to engage the undersurface of the lowermost item 122. With this progressive vacuum being applied to the cylinder surface 46, the undersurface of the lowermost item 122 is progressively engaged to the cylinder surface 46 and away from the stack 116 to the endless conveyor 106.

Figure 8:
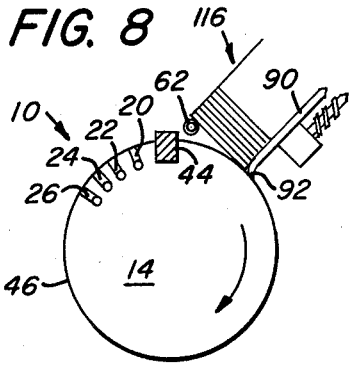
FIGS. 8–13 are similar schematic illustrations of the manner in which a pair of items are initially moved relative to the stack and thereafter the items are singly positioned on the endless conveyor therebelow.
Figure 9:
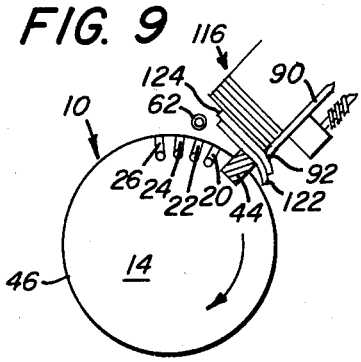
Figure 10:
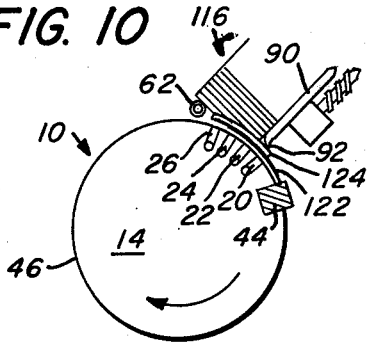
Figure 11:
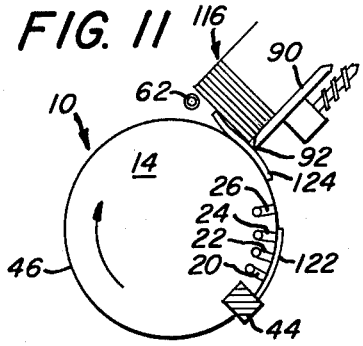
Figure 12:
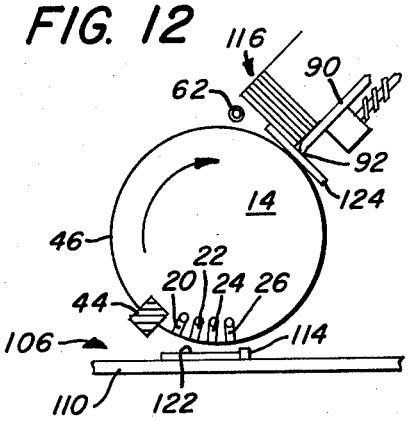

Referring to FIGS. 8–13 where the items in stack 116 have a reduced thickness, there is illustrated the manner in which the feeder apparatus selectively removes a single item from the stack even where a plurality of items are initially moved by the protuberance 44. FIG. 8 illustrates the cylinder 14 rotating in a clockwise direction toward the stack of items 116. FIG. 9 illustrates the protuberance 44 advancing a pair of items beneath the wiper mechanism lower edge 92. The protuberance 44 strikes the lowermost item 120 and because of the thickness of the items or the coefficient of friction between the items caused by heavy printing on the surface of the items, more than one item is advanced beneath the wiper mechanism lower edge 92. Because the vacuum ports 20–26 are deenergized, further movement of the items is dependent on the protuberance 44. The protuberance 44 advances beyond the front or leading edge of the lowermost item 122 and the item 122 abuts the cylinder surface 46. As the vacuum ports 20–26 pass beneath the wiper mechanism 90, the valve 36 progressively actuates the respective ports to engage the underside of the lowermost item 122 to the cylinder surface 46. The actuation of the vacuum ports 20–26 progressively engage and advance the lowermost item 122 while the item thereabove remains engaged between the wiper mechanism lower edge 92 and cylinder surface 46. The wiper mechanism lower edge 92 restrains the next-to-lowermost item 124 from advancing with the cylinder 14. The lowermost item 122 is then conveyed on the surface of the cylinder and is deposited on the endless conveyor 106.

Figure 13:
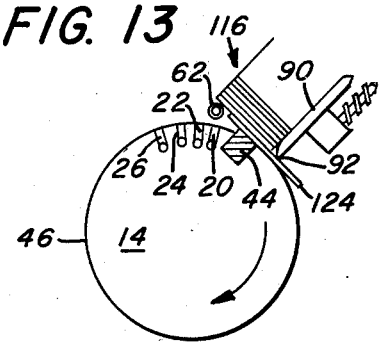
Figure 14:
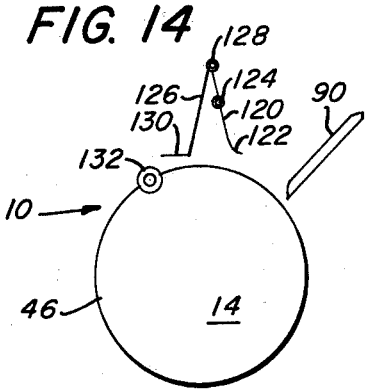
FIG. 14 is a schematic illustration of a guide member that is pivotally mounted on the auxiliary support and periodically swings toward the stack to fan out the lower members of the stack and urge the front edge portions toward the bottom edge of the wiper device.

During the next cycle, the protuberance 44 strikes the underside of the next-to-lowermost item 124 and advances the item beyond the edge of the wiper mechanism 90. Since the next-to-lowermost item 124 has only moved to the position as illustrated in FIG. 13, the protuberance 44 strikes the underside of the next-to-lowermost item 124 and advances the next-to-lowermost item 124 to a position where the vacuum ports 20–26 progressively engage the undersurface of the next-to-lowermost item 124 and convey the next-to-lowermost items to the endless conveyor 106.

Where the stack 116 has been reduced to about 10 items it has been found advantageous to fan out or push the front edges of the lowermost items in the stack against the wiper 90 and particularly toward the wiper lower edge portion 92. The guide member 80, because of its resilient connection to the auxiliary support 68 has a tendency to fan out the last 9 or 10 items in the stack to thus permit the items to move into abutting relation with the wiper 90 and to be engaged by the protuberance 44. As illustrated in FIG. 14, there is provided another embodiment of a guide member 120 which is arranged to pivot away from the stack by means of a bearing 132 mounted on the side of cylinder 14. The guide is pivotally supported on the auxiliary support 68 and has a curved lower portion 122 that pivots toward the stack and tends to tilt the stack about 20° to positively feed the lowermost items adjacent the wiper 90 so that the lowermost items may be conveyed by the protuberance 44 and the vacuum ports 20–26.

According to the provisions of the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. Apparatus for feeding items from a stack comprising, a stack receiver arranged to support a stack of items, a cylinder rotatably mounted adjacent to and beneath said stack receiver, a protuberance extending along the surface of said cylinder, vacuum means on the surface of said cylinder positioned adjacent to said protuberance, a wiper device positioned adjacent to said cylinder surface and said stack receiver, said protuberance arranged upon rotation of said cylinder to contact the lowermost item in a stack positioned on said stack receiver and move at least the leading edge portion of said lowermost item beyond said wiper device, and valve means to actuate said vacuum means on said cylinder when said vacuum means rotates past said wiper device so that the undersurface of the lowermost item is engaged to the cylinder surface.

2. Apparatus for feeding items from a stack as set forth in claim 1 which includes, a support member positioned above said cylinder and arranged to support the rear portion of said stack above said cylinder surface.

3. Apparatus for feeding items from a stack as set forth in claim 1 in which, said vacuum means includes a plurality of rows of vaccuum ports.

4. Apparatus for feeding items from a stack as set forth in claim 1 in which, said wiper device includes a flexible bottom edge portion arranged to be positioned closely adjacent said cylinder surface.

5. Apparatus for feeding items from a stack as set forth in claim 1 in which, said cylinder includes a longitudinal recessed portion, a bar member positioned in said cylinder recessed portion and having an upper surface extending beyond said cylinder surface and forming said protuberance thereon.

6. Apparatus for feeding items from a stack as set forth in claim 1 which includes, arcuate guide members positioned adjacent to said cylinder surface, said arcuate guide members having a configuration substantially the same as said cylinder configuration.

7. Apparatus for feeding items from a stack as set forth in claim 1 in which, said stack receiver includes a backing plate with a pair of rail members, an auxiliary support member positioned adjacent to said backing member and arranged to urge said stack toward said rail members.

8. Apparatus for feeding items from a stack as set forth in claim 7 in which, said wiper device is secured to said backing member and depends downwardly therefrom.

9. Apparatus for feeding items from a stack as set forth in claim 1 which includes, an endless conveyor means positioned beneath said cylinder, said endless conveyor means having spaced pin members extending upwardly therefrom, said endless conveyor means arranged to receive said items conveyed by said cylinder from said stack of items and said pin members arranged to abut an edge of said item and convey said item on said endless conveyor means.

10. Apparatus for feeding items from a stack as set forth in claim 9 in which, said valve means is arranged to deenergize said vacuum means on said cylinder when said vacuum means rotates past said endless conveyor device to thereby disengage the undersurface of said lowermost item from said cylinder surface.

11. A method for feeding items from a stack comprising, positioning a stack of items in a stack receiver above a rotatable cylinder having a protuberance projecting beyond the surface of the cylinder and vacuum means on the surface of the cylinder, rotating the cylinder in a direction toward the leading edge of the stack, striking the lowermost item in the stack with the protuberance and moving the lowermost item in the direction of cylinder rotation, and thereafter engaging the undersurface of said lowermost item to the surface of said cylinder by said vacuum means and moving the lowermost item away from the stack by said vacuum means.

12. A method for feeding items from a stack as set forth in claim 11 which includes, disengaging the undersurface of said lowermost item from the surface of said cylinder and depositing the lowermost item on a conveyor means.

* * * * *